US005330415A

United States Patent [19]

Storti et al.

[11] Patent Number: 5,330,415

[45] Date of Patent: Jul. 19, 1994

[54] INCUBATOR WITH REMOTE CONTROL AND DISPLAY MODULE

[75] Inventors: William J. Storti, Norristown; William A. Heineman, Penns Park; Robert K. Vaccaro, Philadelphia, all of Pa.

[73] Assignee: Air-Shields, Inc., Hatboro, Pa.

[21] Appl. No.: 587,573

[22] Filed: Sep. 24, 1990

Related U.S. Application Data

[63] Continuation of Ser. No. 315,974, Feb. 27, 1989, abandoned.

[51] Int. Cl.[5] ..... A61G 11/00; A61G 10/00; A61H 31/00; A62B 31/00

[52] U.S. Cl. ..... 600/22; 128/205.26; 248/911

[58] Field of Search ..... 600/200; 128/28, 30, 128/670-667, 710-712, 906; 433/205, 26, 29; 312/209, 269, 88; 355/248, 249, 289; 248/917-918, 176, 185, 214, 218.14, 29.1, 232.2, 221.3, 222.1, 370, 415, 418, 424, 425, 666, 667, 676, 592

[56] References Cited

U.S. PATENT DOCUMENTS

| | | | |
|---|---|---|---|
| 3,335,713 | 8/1967 | Grosholz et al. | 600/22 |
| 3,338,233 | 8/1967 | Grozholz et al. . | |
| 3,464,388 | 9/1969 | Stout | 600/22 |
| 3,858,570 | 1/1975 | Beld et al. . | |
| 3,919,999 | 11/1975 | Gluck et al. | 600/22 |
| 3,920,000 | 11/1975 | Atherton et al. . | |
| 4,437,638 | 3/1984 | Scheibenflug . | |
| 4,452,499 | 6/1984 | Verbury | 248/676 |
| 4,617,912 | 10/1986 | Beer et al. . | |
| 4,620,808 | 11/1986 | Kurtin et al. | 248/919 |
| 4,657,004 | 4/1987 | Coffey | 128/65.23 |
| 4,681,090 | 7/1987 | Koch . | |
| 4,788,965 | 12/1988 | Milani et al. . | |
| 4,809,677 | 3/1989 | Mackin et al. | 600/22 |
| 4,895,161 | 1/1990 | Cudahydal | 128/710 |
| 4,896,673 | 1/1990 | Rose et al. | 128/660.03 |

FOREIGN PATENT DOCUMENTS

| | | | |
|---|---|---|---|
| 3014478 | 1/1982 | Fed. Rep. of Germany . | |
| 0888367 | 12/1943 | France | 600/22 |

OTHER PUBLICATIONS

"Markt"; Flachmonitor am Schwenkarm; Rein Elektronik.

*Primary Examiner*—Randall L. Green
*Assistant Examiner*—K. Reichle
*Attorney, Agent, or Firm*—Ratner & Prestia

[57] ABSTRACT

An infant incubator in which the controls and displays are provided in a module which is in proximity to but spaced from and above the hood of the incubator at generally the eye-level of a standing adult.

3 Claims, 2 Drawing Sheets

INCUBATOR WITH REMOTE CONTROL AND DISPLAY MODULE

This application is a continuation of application Ser. No. 07/315,974 filed Feb. 27, 1989, now abandoned.

TECHNICAL FIELD

The present invention relates, in general, to infant incubators and, in particular, to an infant incubator having a control and display module positioned for easier access and better viewing than provided by currently known incubators.

BACKGROUND ART

An incubator is a medical unit which provides a controlled environment for a premature or otherwise delicate or sick infant. The incubator isolates the infant from the outside atmosphere which might be the source of infections or which might be inadequate to aid the infant in overcoming his difficulty.

Infant incubators generally are provided with control means for adjusting the environment within the incubator (i.e., the temperature, humidity, and oxygen content of the atmosphere within the incubator) and display means for indicating the conditions of the environment within the incubator and the condition of an infant positioned within the incubator (i.e., respiration rate and skin temperature). All known incubators have the controls and displays mounted on the front of the base of the incubator and below the hood. This location of the controls and displays is inconvenient to those attending to the care of an infant within the incubator. One must bend down to read the displays and, when the front door of the incubator is open to provide complete access to an infant, one must work around the open front door. In addition, in order to observe the displays which indicate the conditions within the incubator and the condition of the infant, one must be right at the incubator and cannot observe these displays from a remote location.

DISCLOSURE OF INVENTION

An incubator, constructed in accordance with the present invention, includes a base having an infant support and a hood mounted on the base and adapted to enclose the infant support. Also included are air conditioning means for developing conditioned air within the base and below the infant support and for circulating the conditioned air from below the infant support into the hood and returning air from the hood to below the infant support. This incubator further includes first sensing means for developing signals representative of the conditions of the environment within the hood and second sensing means for developing signals representative of the condition of an infant positioned within the hood. A control and display module is provided for (1) controlling the environment within the hood and (2) displaying the conditions of the environment within the hood and the condition of an infant within the hood. The control and display module is mounted at a position in proximity to but spaced from and above the hood at generally the eye-level of a standing adult. Also included are means for transmitting and receiving signals between the control and display module and: (1) the air conditioning means to control the environment within the hood, and (2) the first and the second sensing means to display the conditions of the environment within the hood and the condition of an infant positioned within the hood.

BRIEF DESCRIPTION OF THE DRAWING

Referring to the drawing.

BEST MODE OF CARRYING OUT THE INVENTION

Figure 1:
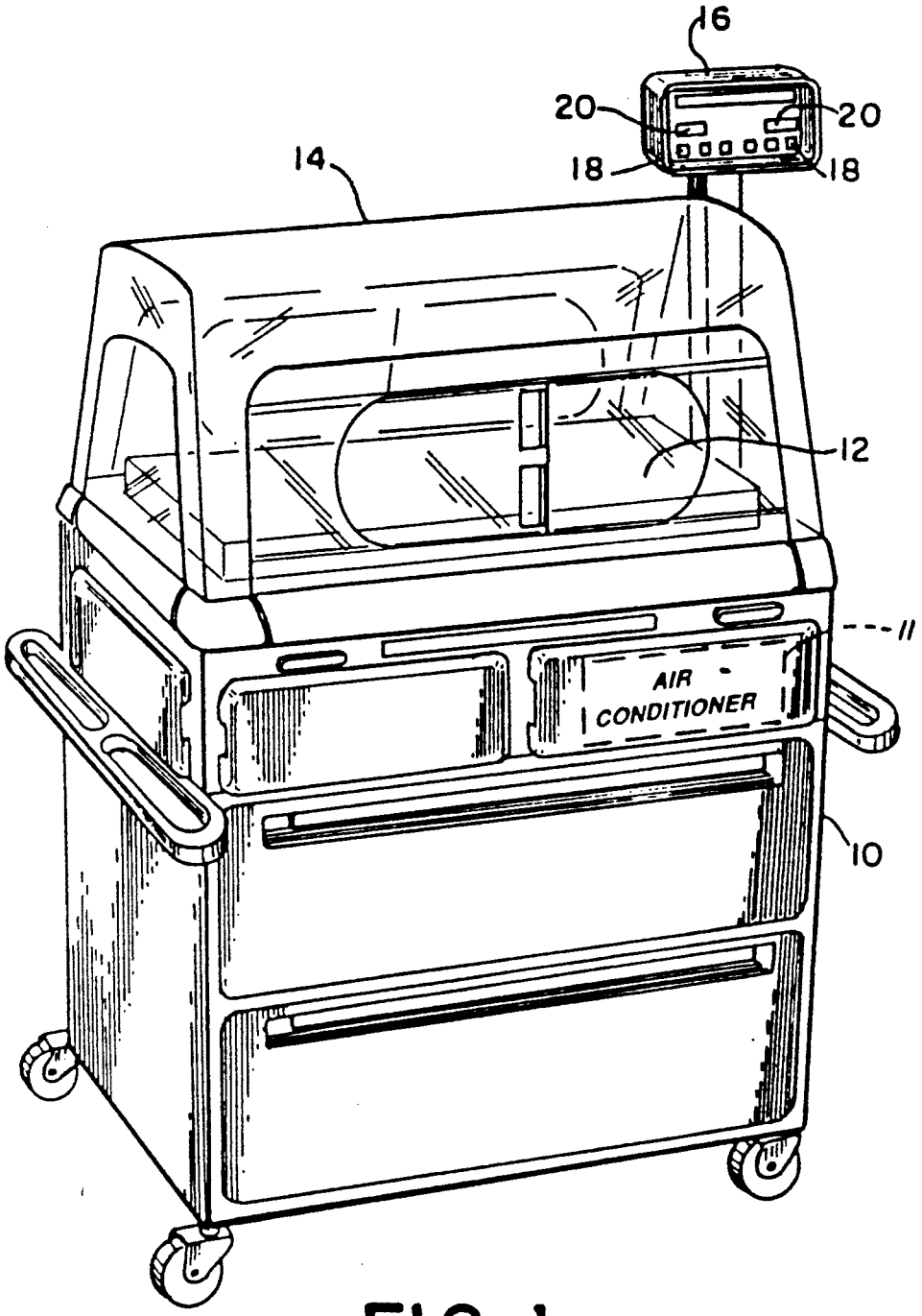
FIG. 1 is a front, perspective view of an infant incubator constructed in accordance with the present invention.

U.S. Pat. No. 3,335,713 is incorporated herein by reference to supplement the disclosure of various components of an incubator, the details of which do not form a part of the present invention.

Referring to the drawing, an incubator, constructed in accordance with the present invention, includes a base 10 having an infant support 12 and a hood 14 mounted on base 10 and adapted to enclose infant support 12. Also included in the incubator are air conditioning 11 means for developing conditioned air within base 10 and below infant support 12 and for circulating the conditioned air from below the infant support into hood 14 and returning air from the hood to below the infant support. For additional details on an infant support which can be used and the apparatus for developing and circulating conditioned air, reference is made to U.S. Pat. No. 3,335,713.

An incubator, constructed in accordance with the present invention, also includes first sensing means for developing signals representative of the conditions of the environment within hood 14 and second sensing means for developing signals representative of the condition of an infant positioned within the hood. The first sensing means can include, for example, a thermometer positioned at an appropriate location within hood 14 for developing a signal representative of the temperature within the hood. The second sensing means can include, for example, a skin temperature probe attached to the infant for developing a signal representative of the temperature of the infant. For additional details on the various sensors which can be used to monitor the incubator conditions and the condition of the infant, reference is made to U.S. Pat. No. 3,335,713.

An incubator, constructed in accordance with the present invention, further includes a control and display module 16 for controlling the environment with hood 14 and displaying the conditions of the environment within the hood and the condition of an infant within the hood. Control and display module 16 has a plurality of controls 18 which can control, for example, the temperature, humidity, oxygen content and circulation rate of the conditioned air which is introduced into hood 14. Control and display module 16 also has a plurality of displays 20 which can display the various parameters of the hood environment and the physical condition of the infant. The circuitry for effecting the desired controls and developing the desired displays can be of conventional construction and operation.

Control and display module 16 is positioned in proximity to but spaced from and above hood 14 at generally the eye-level of a standing adult. The positioning of control and display module 16 is such that it is clear of movement of hood 14 as the hood is pivoted to an open position about an axis extending along the rear side of base 10.

Figure 2:
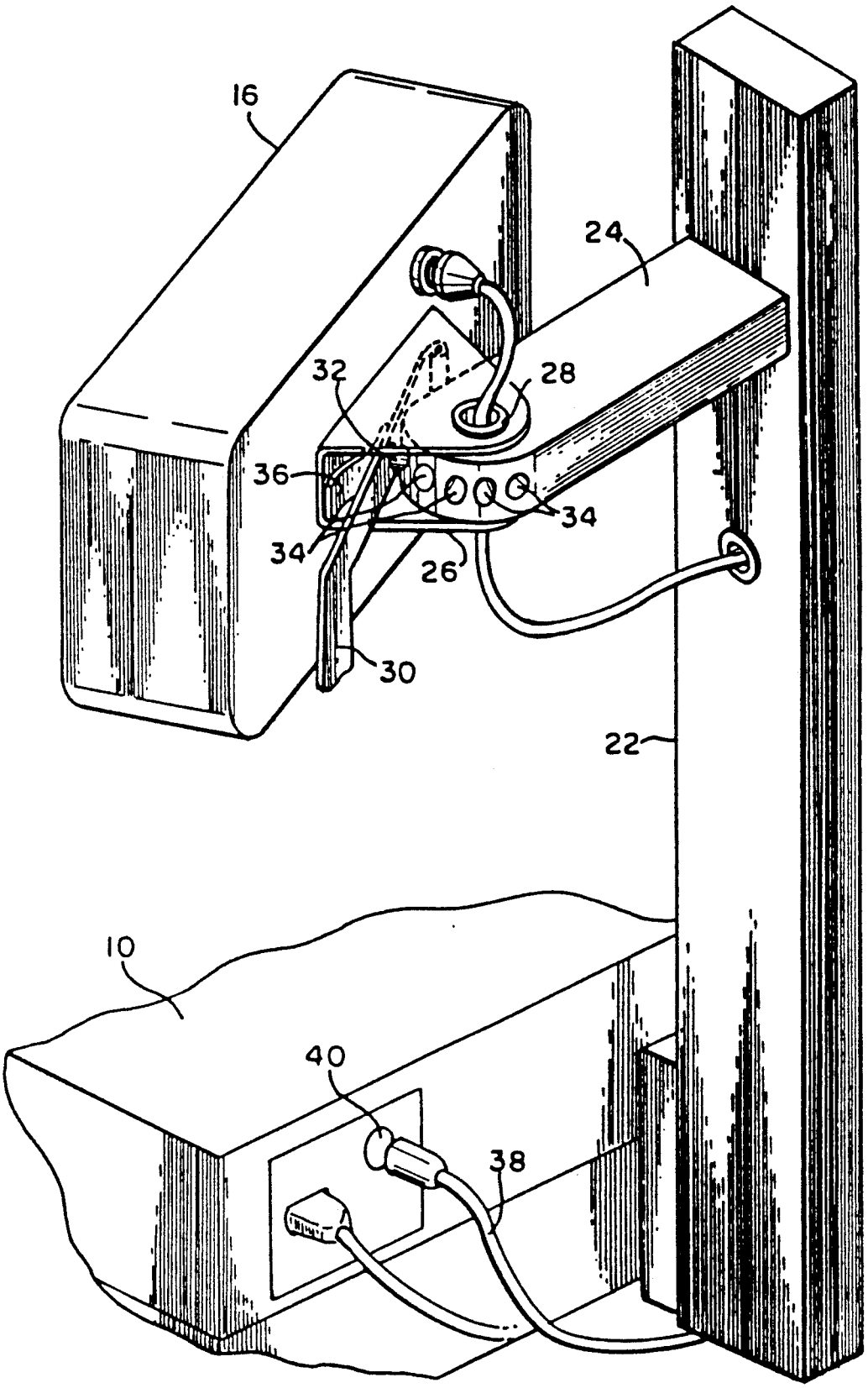
FIG. 2 is a rear perspective view showing the manner in which the control and display module of the incubator is mounted on the base of the incubator.

As shown most cl early in FIG. 2, control and display module 16 is mounted by means of a vertically disposed post 22 which is attached at its lower end to base 10 and has the control and display module attached to its upper end. In the preferred embodiment of the invention, control and display module 16 is mounted for pivotal movement about a vertical axis. As a result, the control and display module can be positioned to suit the needs of those attending the infant in the incubator as they treat the infant or monitor the infant and the incubator conditions from a remote location.

Control and display module 16 is attached to post 22 by means of a support arm 24 which is attached to the post, a bracket 26 to which the control and display module is attached, and a sleeve 28 which extends through vertically aligned openings in the support arm and the bracket and defines the vertical axis about which the control and display module pivots.

A locking mechanism is provided to fix the position of control and display module 16. For the embodiment of the invention illustrated, this locking mechanism includes a release latch 30 attached to bracket 26 for pivotal movement toward and away from support arm 24. Release latch 30 carries a pin 32 which is movable into and out from a series of openings 34 in support arm 24 as the release latch is moved toward and away from the support arm. A leaf spring 36, attached to bracket 26 and bearing against release latch 30, urges the release latch toward support arm 24, so that pin 32, carried by the release latch, will enter one of the openings 34 and lock control and display module 16 in place. To move the control and display module, release latch 30 is moved away from support arm 24 against the action of leaf spring 36 to retract pin 32 from opening 34. While pin 32 is clear of any opening 34, control and display module 16 can be moved to the desired position and when release latch 30 is released, pin 32 can enter an opening 34 at the new position of the control and display module.

Also included in an incubator, constructed in accordance with the present invention, are means for transmitting and receiving signals between control and display module 16 and the air conditioning means 11 and the first and second sensing means. Such means include wires 38 which extend between a connector 40 in base 10 and control and display module 16. The sensors in hood 14 and on the infant and the air conditioning means 11 are electrically connected to connector 40 in the usual manner. In this way, controls 18 on the control and display module control the operation of the air conditioning means 11 to control the environment within hood 14 and displays 20 on the control and display module display the conditions of the environment within the hood and the condition of an infant positioned within the hood. For the embodiment of the invention illustrated, post 22 is hollow and wires 38 extend from base 10 through the post. Wires 38 exit post 22 and extend beneath support arm 24 and up through sleeve 28 to control and display module 16.

While in the foregoing there has been described a preferred embodiment of the invention, it should be understood to those skilled in the art that various modifications and changes can be made without departing from the true spirit and scope of this invention.

We claim:

1. In an incubator including infant support means for an infant, a transparent hood adapted to enclose the infant support means in a protective environment, an air conditioner which is responsive to a control signal to develop conditioned air for circulation to provide a controlled environment in the hood and first and second sensor means for developing first and second signals, respectively representative of conditions of the environment within the hood and of an infant positioned within the hood, apparatus comprising:

base means for holding said air conditioner and having a top surface upon which said infant support means are positioned and upon which said hood is mounted;

control and display means for (1) generating said control signal to control the environment within said hood, and (2) displaying the conditions of the environment within said hood and the condition of an infant positioned within said hood in response to the respective first and second signals;

mounting means for positioning said control and display means in proximity to said hood at generally the eye-level of a standing adult;

and means for transmitting said first and second signals to said control and display means and for receiving said control signal from said control and display means to effect the control of the environment within said hood and the display of the conditions of the environment within said hood and of the infant positioned within said hood.

2. Apparatus according to claim 1 wherein said support arm and said bracket have openings which are aligned vertically with respect to the top surface of said base means and said means for pivotally mounting said control and display module further include a sleeve extending through said vertically aligned openings.

3. Apparatus according to claim 2 wherein said post is hollow and said means for transmitting and receiving signals include wires extending from said base means through said post and said sleeve to said control and display means.

* * * * *

UNITED STATES PATENT AND TRADEMARK OFFICE

CERTIFICATE OF CORRECTION

PATENT NO. : 5,330,415

DATED : July 19, 1994

INVENTOR(S) : William J. Storti, William A. Heineman, Robert K. Vaccaro

It is certified that error appears in the above-indentified patent and that said Letters Patent is hereby corrected as shown below:

COLUMN 4

Please replace claim 1 with the following:

In an incubator including infant support means for an infant, a transparent hood adapted to enclose the infant support means in a protective environment, an air conditioner which is responsive to a control signal to develop conditioned air for circulation to provide a controlled environment in the hood and first and second sensor means for developing first and second signals, respectively representative of conditions of the environment within the hood and of an infant positioned within the hood, apparatus comprising:

base means for holding said air conditioner, said base means having: a top surface upon which said infant support means are mounted, a rear side and means, coupled to said rear side, for attaching said hood to the base means for pivotal movement of said hood about an axis in the plane containing said rear side; and control and display means for: (1) generating said control signal to control the environment within said hood, and (2) displaying the conditions of the environment within said hood and the condition of an infant positioned within said hood in response to the respective first and second signals;

UNITED STATES PATENT AND TRADEMARK OFFICE

CERTIFICATE OF CORRECTION

PATENT NO. : 5,330,415

DATED : July 19, 1994

INVENTOR(S) : William J. Storti, William A. Heineman, Robert K. Vaccaro

It is certified that error appears in the above-indentified patent and that said Letters Patent is hereby corrected as shown below:

mounting means for positioning said control and display means in proximity to said hood at generally the eye-level of a standing adult and clear of the pivotal movement of said hood, such that the control and display means does not block the view, through the hood, of the adult while attending to the infant, said mounting means including:

a post, vertically disposed with respect to said top surface of said base means, having an upper end and a lower end, means for attaching the lower end of said post to said base, and means, at the upper end of said post, for attaching said control and display means to said post including:

a support arm attached to said post, and a bracket pivotally mounted on said support arm and attached to said control and display means to effect pivotal movement of said control and display means about a vertical axis that is parallel to the longest dimension of said post; and

UNITED STATES PATENT AND TRADEMARK OFFICE

CERTIFICATE OF CORRECTION

PATENT NO. : 5,330,415

DATED : July 19, 1994

INVENTOR(S) : William J. Storti, William A. Heineman, Robert K. Vaccaro

It is certified that error appears in the above-indentified patent and that said Letters Patent is hereby corrected as shown below:

means for locking said bracket at a selected pivotal position, including:

a series of openings in said support arm, a release latch which moves toward and away from said series of openings in concert with the pivotal movement of said bracket relative to said support arm and having a pin movable into and out from said openings, and means for urging said release latch toward said series of openings; and means for transmitting said first and second signals to said control and display means and for receiving said control signal from said control and display means to effect the control of the environment within said hood and the display of the conditions of the environment within said hood and of the infant positioned within said hood.

UNITED STATES PATENT AND TRADEMARK OFFICE

CERTIFICATE OF CORRECTION

PATENT NO. : 5,330,415

DATED : July 19, 1994

INVENTOR(S) : William J. Storti, William A. Heineman, Robert K. Vaccaro

It is certified that error appears in the above-indentified patent and that said Letters Patent is hereby corrected as shown below:

In claim 10, column 4, line 47, the words "pivotally mounted" should be deleted and --attaching-- substituted therefor.

Signed and Sealed this

Sixth Day of December, 1994

*Attest:*

Bruce Lehman

BRUCE LEHMAN

*Attesting Officer*

*Commissioner of Patents and Trademarks*